US007578409B1

(12) United States Patent
Kulasik

(10) Patent No.: US 7,578,409 B1
(45) Date of Patent: Aug. 25, 2009

(54) QUICK LINER RELEASE STRIP FOR WASTE CONTAINERS

(76) Inventor: Stanley Jan Kulasik, 55 Horseshoe Ln, Lemont, IL (US) 60439

( * ) Notice: Subject to any disclaimer, the term of this patent is extended or adjusted under 35 U.S.C. 154(b) by 748 days.

(21) Appl. No.: 11/052,667

(22) Filed: Feb. 7, 2005

Related U.S. Application Data

(60) Provisional application No. 60/544,747, filed on Feb. 13, 2004.

(51) Int. Cl.
*B65F 1/08* (2006.01)

(52) U.S. Cl. ..... 220/495.04; 220/495.06

(58) Field of Classification Search ..... 220/908.1
See application file for complete search history.

(56) References Cited

U.S. PATENT DOCUMENTS 2,819,731 A * 1/1958 Louthan ..... 138/38
3,792,722 A * 2/1974 Harmon ..... 138/108
4,294,379 A 10/1981 Bard
4,420,016 A * 12/1983 Nichols ..... 138/103
4,715,572 A 12/1987 Robbins, III et al.
5,065,891 A 11/1991 Casey
5,156,290 A 10/1992 Rodrigues
5,375,732 A 12/1994 Bowers et al.
5,388,717 A 2/1995 LeVasseur
5,492,241 A * 2/1996 Barnett et al. ..... 220/694
6,015,063 A 1/2000 Poliquin
6,594,876 B1 7/2003 Stastny
6,634,518 B1 * 10/2003 Jones ..... 220/495.04
6,736,281 B2 * 5/2004 Joseph ..... 220/495.04

OTHER PUBLICATIONS

Kulasik, U.S. Appl. No. 60/544,747, filed Feb. 13, 2004 A.D. McKechnie et al. (Eds.), Webster's New Universal Unabridged Dictionary, Second Edition, 1983 A.D., Dorset & Baber, Cleveland, pp. 922 (right hand column)—923 (first two colums); 959; 1233 (right hand column)—1234 (left hand column); and 1524.

* cited by examiner

*Primary Examiner*—Stephen Castellano
(74) *Attorney, Agent, or Firm*—Christopher John Rudy

(57) ABSTRACT

Quick liner release strip has a substantially straight, hollow conduit for communication of air, which includes a means for ready attachment of the conduit to an inside wall of the container, and at least one of an oblique lower terminus and internal reinforcing. The strip can be affixed to the inside of a waste container or the like.

20 Claims, 1 Drawing Sheet

QUICK LINER RELEASE STRIP FOR WASTE CONTAINERS

This claims benefits under 35 USC 119(e) of U.S. provisional patent application No. 60/544,747 filed on Feb. 13, 2004 A.D. The specification of that application is incorporated herein by reference in its entirety.

BACKGROUND TO THE INVENTION

II. Field and Purview

This invention concerns a quick liner release strip for a waste container, for fixation on an inside wall of the container to provide for air to a bottom part of the container. The strip, which is substantially straight overall and has a hollow conduit for communication of the air, has an oblique lower terminus and/or internal reinforcing.

II. Art and Problems

The advent of the liner bag for plastic trash cans has made garbage disposal more tidy. It also brought with it problems of liner insertion or removal difficulties from too much or little air between liner and can, especially removal when full, owing to the vacuum force encountered when pulling the liner from the can.

Some art addresses venting for the purpose of insertion or filling of the liner bag. See, e.g., U.S. Pat. Nos. 4,715,572 to Robbins, III et al., and 5,065,891 to Casey.

In addressing the problem of difficult removal, various art has been developed to permit communication of air under the bag to relieve the vacuum, among which may be mentioned, in addition to Robbins, III et al., U.S. Pat. Nos. 4,294,379 to Bard, 5,156,290 to Rodrigues, 5,375,732 to Bowers et al., and 5,388,717 to LeVasseur, all showing containers that have built-in features for ingress of air. Among drawbacks of such art include the increased complexity of the containers, which makes for increased cost; a difficulty in keeping these containers with their vents clean; and, notably in a trash can as of LeVasseur, an increased likelihood of leakage when liquids are stored for disposal.

Attachable vent devices especially for ingress of air to aid in removal of the liner have also been proposed, among which are mentioned those found in U.S. Pat. Nos. 5,492,241 to Barnett et al., 6,015,063 to Poliquin, 6,594,876 to Stastny, and 6,634,518 to Jones. Among drawbacks of such art generally can include a relatively heavy construction for the tube or conduit vent; a more complicated three-dimensional shape for the vent such as in Jones or its attachment member such as in Poliquin; inadvertent and sometimes messy removal of an unsecured vent with removal of a full bag such as with an embodiment from Poliquin, Jones, or Stastny; a difficulty if not near impossibility of adaptation to variously sized containers as in the devices of Barnett et al., Poliquin, and Jones; and drilling holes in the container itself such as taught in Stastny, which can damage the container.

Another drawback is that a liner may get torn from a vent with a sharply protruding end, especially during removal and when it is full, causing spillage of its contents. Compare, Bard, Barnett et al., and Poliquin.

It would be desirable to ameliorate or solve such drawbacks.

DISCLOSURE OF THE INVENTION

In general, the present invention provides a quick liner release strip for a waste container or the like, comprising a substantially straight, hollow conduit for communication of air, which includes a means for ready attachment of the conduit to an inside wall of the container, and at least one of an oblique lower terminus and internal reinforcing. The invention also provides, in combination, the strip affixed to the container.

The invention is useful in waste management and so forth.

Significantly, by the invention, not only can insertion of a liner bag can be made easy, and a bag with refuse or other matter pulled from the container readily through release of vacuum pressure, but also drawbacks pertinent to the art are ameliorated or overcome. Not the least among these is the tearing of the bag or other liner, which is ameliorated or solved by the oblique lower terminus to the strip. The internal reinforcing allows for employment of thinner walls in the strip, which can provide for an ability to snip off the strip to a convenient length to fit various sized waste containers from small wastebaskets to large garbage cans, of many shapes including generally rectangular to conical, cylindrical or ovoid. The substantially straight form of the strip provides enhanced simplicity in manufacture, and enhances the ability to fit various sized containers. The means for ready attachment can keep the strip from inadvertent removal with the liner, and may be such that the strip can be removably attached, say, when soiled, with a new strip affixed as a replacement. Numerous further advantages attend the invention.

The drawings form part of the specification hereof. With respect to the drawings, which are not necessarily drawn to scale, the following is briefly noted:

Figure 1:
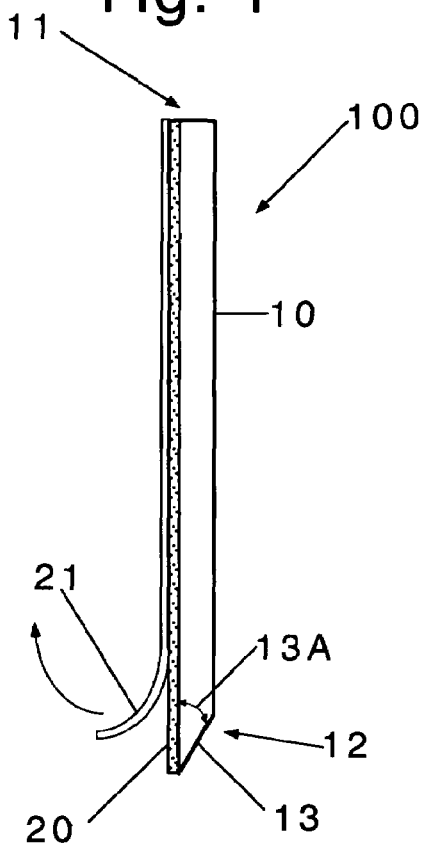
FIG. 1 is a side view of an embodiment of a quick liner release strip for a waste container or the like of the invention.
Figure 2:
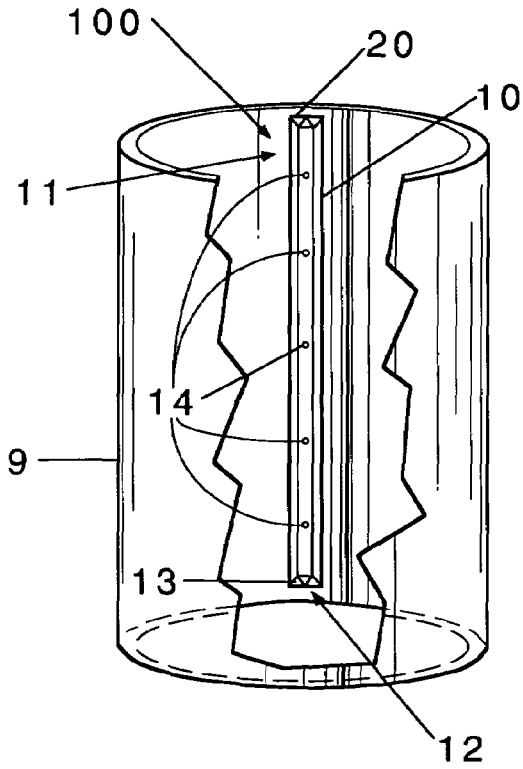
FIG. 2 is a perspective view of the strip of FIG. 1, affixed to an inside wall of a garbage can.
Figure 3:
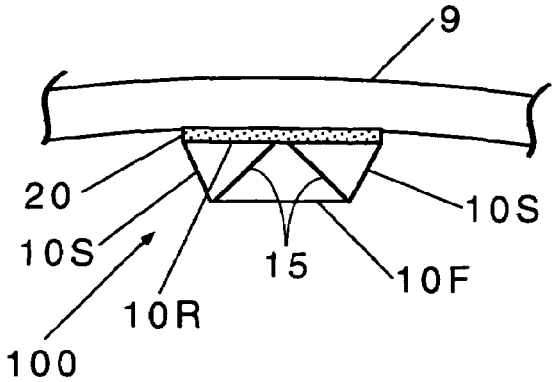
FIG. 3 is a top view of the strip as found in FIG. 2.

The invention can be further understood by the following detail, which may be read in view of the drawings. Such is to be taken in an illustrative and not necessarily limiting sense.

The quick liner release strip is for a waste or equivalent container, and includes a substantially straight, hollow conduit for communication of air; a means for ready attachment of the conduit to an inside wall of the container; and one or more of an oblique lower terminus and internal reinforcing. Typically, the conduit communicates the air from an opening about a first end, which may be deemed the top, to a second end, which may be deemed the lower end. In turn, when attached to the inside wall of the container, air can be forced out through the conduit from the lower terminus to the top, when the liner is being placed in the container or filled; and drawn in through the conduit from the top to the lower terminus to relieve a vacuum when the liner is being removed. Additional holes or perforations in the conduit between its top and lower end may be provided, for additional communication of air about these intermediate points. Attachment of the conduit to the inside wall of the container can be provided by any suitable means that makes for ready affixation such as, for example, hook and loop contrivances, static or magnetic force, or adhesive. Preferably, the means for ready attachment is provided by the adhesive, for example, as is well known in the art, an adhesive strip provided with a protective cover that is removed to expose underlying adhesive when the strip is to be attached. Advantageously, the means for ready attachment of the strip is such that the strip can be secured yet removably attached to the inside wall of the container. In the case of the adhesive, for example, this can be accomplished through employment of an adhesive that has a less than permanent character, or that has an adhesive strength and quality that permits the strip to be removed by the application of a sufficient shear force or peel, desirably which, however, is greater than that encountered during removal of a full liner. The adhesive can be provided to accommodate roughened or "orange peel" type finish interior surfaces of certain waste containers. The strip also has an oblique lower terminus, or the internal reinforcing, or both of these. The oblique lower terminus provides for a ramp, as it were, for the liner to ride up and over, thus reducing rips and tears in the liner when it is removed. The internal reinforcing, as noted above, allows for employment of thinner walls in the conduit strip, which provides an ability to snip off the strip to a convenient length to fit various sized waste containers. In turn, this can provide for the ability to more readily snip the strip to any desired length such as by household scissors.

Any suitable material and method may be employed to make the invention. For the conduit, such a material may include softer metals such as aluminum, copper or tin; plastics and/or rubbers to include polyolefins including polyethylene, polypropylene, butadiene; polystyrenes including alphabutylstyrenes, and related polymers and halogenated versions thereof; vinyl polymers including halogenated versions such as polyvinylchloride; polyethyleneterephthalate; polyamides; cellulose polymers; silicones; and so forth. As for any means for ready attachment not incorporated monolithically with the conduit, any suitable material known or developed in the art may be employed as well. Such materials can include glues, caulks, and other adhesives, and can include adhesive tapes, to include as an expedient, well known duct tape, and/or other tapes, to include double-sided tape that may have a thin or even a foam core, and so forth. The lists of such materials, of course, are not exhaustive.

Figure 4:
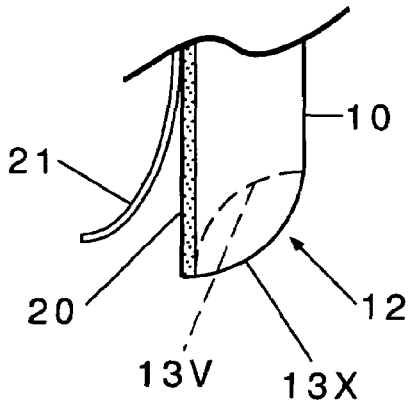
FIG. 4 is a side view of another strip embodiment hereof.

With particular reference to the drawings, quick liner release strip 100 for waste container such as garbage can 9 includes substantially straight, hollow conduit 10 and means for ready attachment of the conduit to inside wall of the container, for example, by adhesive 20. The conduit 10, made, say, of an extruded plastic, includes front wall 10F of any suitable width but, say, about one third of an inch, substantially flat rear wall 10R of any suitable width but, say, about an inch, and side walls 10S of any suitable width but, say, of a length sufficient to provide for an about ¼-inch distance between the front wall 10F and rear wall 10R; and has first, upper end 11, and second, lower end 12. Air can pass through the conduit 10 to or from the upper end 11 from or to the lower end 12. The lower end 12 has oblique terminus 13 that can have a generally linear boundary with oblique angle 13A with respect to the conduit length at its rear, which is less than a 90-degree angle, to include an angle about from sixty to twenty degrees to include about from twenty-five to forty-five degrees, for example, about thirty degrees (FIG. 1). As an alternative, the oblique terminus 13 may be provided by a rounding about the lower end 12, which, for example, may be concave 13V or convex 13X (FIG. 4). One or more intermediate holes 14 may be provided in the conduit 10. The conduit 10 has internal reinforcing 15 from inside walls. The thickness of each wall 10F, 10R, 10S and the reinforcing 15 is desirably of a thickness that can provide for enough support or rigidity to substantially keep the hollow conduit passage(s) open for communication of air while not being so thick that the hollow conduit 10 employs an excessive amount of material. The adhesive 20, which may be specially manufactured or commercially obtained off the shelf, is advantageously in a form of an adhesive strip protected by pull-off cover 21. There is provided a sufficient amount of adhesive based on its properties to suit the purpose of adhering the strip 100 with the strength or permanence and for the time desired. With certain off the shelf adhesives such as two sided tape or spray adhesive, with respect to the exemplary dimensions given above, the front wall 10F may stand out from the can about from 0.33 to 0.375 inches or more. The cover 21 may be kept in place for sizing of the strip 100 with respect to the height of the can 9, and trimming the strip 100 if necessary, say, by household scissors, and then the cover 21 is removed before installing the strip 100 on the inside wall of the can 9.

The present invention is thus provided. Various features, parts, subcombinations and combinations can be employed with other features, parts, subcombinations or combinations in the practice of the invention, and numerous adaptations and modifications can be effected within its spirit, the literal claim scope of which is particularly pointed out as follows:

I claim:

1. A quick liner release strip useful for substantially vertical attachment to a substantially vertical inside wall of a waste container that can hold a liner that can hold waste, comprising a substantially straight, hollow conduit, which has a length, which is for communication of air, and which includes a means for ready attachment of the conduit to the substantially vertical inside wall of the waste container, and an oblique lower terminus, which is oblique with respect to the length of the conduit, wherein the conduit has an upper opening and a lower opening, one of which is for inlet of air with the other for outlet of air, wherein a longitudinal axis extends only inside the conduit from the upper opening to the lower opening with some portion of both openings aligned along the longitudinal axis of the conduit.

2. The strip of claim 1, wherein the oblique lower terminus provides for a ramp for the liner to ride up and over, and the strip is adapted to be attached substantially vertically to the substantially vertical inside wall of the waste container, thus reducing rips and tears in the liner when it is removed.

3. The strip of claim 2, which includes a front wall, a substantially flat rear wall, and side walls, as well as a first, upper end, and second, lower end; and wherein the oblique lower terminus has an oblique angle with respect to the conduit length at its rear, which is about from sixty to twenty degrees.

4. The strip of claim 3, wherein said angle is about from twenty-five to forty-five degrees.

5. The strip of claim 1, wherein said means for ready attachment includes an adhesive such that the strip can be secured yet removably attached to the inside wall of the waste container.

6. A quick liner release strip useful for attachment to an inside wall of a waste container that can hold a liner that can hold waste, comprising a substantially straight, hollow conduit for communication of air, which includes a means for ready attachment of the conduit to the inside wall of the waste container, and internal reinforcing that allows for employment of thin walls in the conduit strip, which provides an ability to snip off the strip to a convenient length to fit various sized waste containers, which, in turn, can provide for the ability to more readily snip the strip to any desired length such as by household scissors, while being of a thickness that can provide for enough support or rigidity to substantially keep hollow conduit passage(s) open for communication of air, wherein the internal reinforcing is from inside walls, two of which form a general V-shape joining about a central portion of a substantially flat rear outside wall of the strip and about separate spaced apart junctions with outside walls of the strip away from the substantially flat rear outer wall.

7. The strip of claim 6, which includes as outside walls of the strip away from the substantially flat rear wall, a front wall, and side walls, wherein the internal reinforcing including two inside walls, which form a general V-shape, join about a central portion of the rear wall and about separate junctions of the front wall and the side walls.

8. The strip of claim 6, wherein said means for ready attachment includes an adhesive such that the strip can be secured yet removably attached to the inside wall of the waste container.

9. The strip of claim 7, wherein said means for ready attachment includes an adhesive such that the strip can be secured yet removably attached to the inside wall of the waste container.

10. A quick liner release strip useful for substantially vertical attachment to a substantially vertical inside wall of a waste container that can hold a liner that can hold waste, comprising a substantially straight, hollow conduit, which has a length, which is for communication of air, and which includes a means for ready attachment of the conduit to the substantially vertical inside wall of the waste container, and both an oblique lower terminus, which is oblique with respect to the length of the conduit, and internal reinforcing, wherein the oblique lower terminus provides for a ramp for the liner to ride up and over, and the strip is adapted to be attached substantially vertically to the substantially vertical inside wall of the waste container, thus reducing rips and tears in the liner when it is removed; and internal reinforcing allows for employment of thin walls in the conduit strip, which provides an ability to snip off the strip to a convenient length to fit on substantially vertical walls of various sized waste containers, which, in turn, can provide for the ability to more readily snip the strip to any desired length such as by household scissors, while being of a thickness that can provide for enough support or rigidity to substantially keep hollow conduit passage(s) open for communication of air.

11. The strip of claim 10, wherein the reinforcing is from internal walls.

12. The strip of claim 11, wherein the conduit is made of extruded plastic, and includes a front wall, a substantially flat rear wall, and side walls; and the internal reinforcing includes two walls, which form a general V-shape joining about a central portion of the rear wall with each of the two walls joining about separate junctions of the side walls and the front wall of the conduit.

13. The strip of claim 10, wherein the conduit includes a first, upper end, and second, lower end; and wherein the oblique lower terminus has an oblique angle with respect to the conduit length at its rear, which is about from sixty to twenty degrees.

14. The strip of claim 13, wherein said angle is about from twenty-five to forty-five degrees.

15. A quick liner release strip useful for attachment to an inside wall of a waste container that can hold a liner that can hold waste, comprising a substantially straight, hollow conduit for communication of air, which includes a means for ready attachment of the conduit to the inside wall of the waste container, an oblique lower terminus, which is oblique with respect to the length of the conduit, and internal reinforcing that allows for employment of thin walls in the conduit strip, which provides an ability to snip off the strip to a convenient length to fit various sized waste containers, which, in turn, can provide for the ability to more readily snip the strip to any desired length such as by household scissors, while being of a thickness that can provide for enough support or rigidity to substantially keep hollow conduit passage(s) open for communication of air, wherein the conduit has an upper opening and a lower opening, one of which is for inlet of air with the other for outlet of air, wherein a longitudinal axis extends only inside the conduit from the upper opening to the lower opening with some portion of both openings aligned along the longitudinal axis of the conduit.

16. The strip of claim 15, wherein the internal reinforcing is from inside walls.

17. The strip of claim 16, which includes a front wall, a substantially flat rear wall, and side walls.

18. The strip of claim 15, wherein said means for ready attachment includes an adhesive such that the strip can be secured yet removably attached to the inside wall of the waste container.

19. A quick liner release strip useful for substantially vertical attachment to a substantially vertical inside wall of a waste container that can hold a liner that can hold waste, comprising a substantially straight, hollow conduit, which has a length, which is for communication of air, and which includes a means for ready attachment of the conduit to the substantially vertical inside wall of the waste container, and both an oblique lower terminus, which is oblique with respect to the length of the conduit, and internal reinforcing, wherein the conduit has an upper opening and a lower opening, one of which is for inlet of air with the other for outlet of air, wherein a longitudinal axis extends only inside the conduit from the upper opening to the lower opening with some portion of both openings aligned along the longitudinal axis of the conduit.

20. The strip of claim 19, wherein said means for ready attachment includes an adhesive such that the strip can be secured yet removably attached to the inside wall of the waste container.

* * * * *